US006293537B1

(12) United States Patent
Park

(10) Patent No.: US 6,293,537 B1
(45) Date of Patent: Sep. 25, 2001

(54) PAPER ALIGNING APPARATUS

(75) Inventor: Jin-Ho Park, Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/198,403

(22) Filed: Nov. 24, 1998

(30) Foreign Application Priority Data

Nov. 24, 1997 (KR) ..... 62292

(51) Int. Cl.[7] ..... B65H 9/14

(52) U.S. Cl. ..... 271/10.13; 271/244; 271/246; 271/226; 271/10.12

(58) Field of Search ..... 271/244, 226, 271/246, 10.12, 10.13

(56) References Cited

U.S. PATENT DOCUMENTS

| | | | | |
|---|---|---|---|---|
| 5,160,128 | * | 11/1992 | Oishi | 271/114 |
| 5,222,724 | * | 6/1993 | Hirano et al. | 271/10.11 |
| 5,228,671 | * | 7/1993 | Fish et al. | 271/246 |
| 5,358,230 | * | 10/1994 | Ikemori et al. | 271/114 |
| 5,417,415 | * | 5/1995 | Murakami | 271/227 |
| 5,672,019 | * | 9/1997 | Hiramatsu et al. | 400/624 |
| 5,711,519 | * | 1/1998 | Bortolotti | 271/116 |
| 5,823,523 | * | 10/1998 | Park | 271/10.04 |
| 5,863,036 | * | 1/1999 | Tanaka et al. | 271/10.11 |
| 5,867,196 | * | 2/1999 | Kiyohara et al. | 347/104 |
| 6,135,442 | * | 10/2000 | Hirata et al. | 271/116 |
| 6,142,467 | * | 11/2000 | Funada | 271/246 |
| 6,146,036 | * | 11/2000 | Kim | 400/629 |

FOREIGN PATENT DOCUMENTS

| | | | | |
|---|---|---|---|---|
| 403177247 | * | 8/1991 | (JP) | 271/244 |
| 404085244 | * | 3/1992 | (JP) | 271/244 |
| 404256651 | * | 9/1992 | (JP) | 271/226 |

* cited by examiner

*Primary Examiner*—Donald P. Walsh
*Assistant Examiner*—Daniel K Schlak
(74) *Attorney, Agent, or Firm*—Robert E. Bushnell, Esq.

(57) ABSTRACT

A device of aligning or arranging a paper in a printer comprising a transport part including feed roller and pinch roller, and which transports or counter-transport a paper between the rollers; a pickup roller which supplies a sheet of papers of paper load cassette to the roller; a paper feed plate providing the pressure for the frictional power to pick up a paper; and one-way clutch for preserving frictional power between a pickup roller and a paper when the feed roller which drives the pickup roller rotates in a counter direction.

2 Claims, 3 Drawing Sheets

PAPER ALIGNING APPARATUS

This application makes reference to, incorporates the same herein, and claims all benefits accruing under 35 U.S.C. §119 from an application entitled SHEET REGISTRATION DEVICE AND REGISTRATION METHOD filed with the Korean Industrial Property Office on Nov. 24, 1997 and there duly assigned Ser. No. 62292/1997 by that Office.

BACKGROUND OF THE INVENTION

1. Field of the Invention

The present invention relates to devices for paper feeding and alignment, and more particularly to devices for paper feeding and alignment in a printer such as an ink-jet printer.

2. Discussion of Related Art

Devices such as printers have paper feeding devices for feeding papers stored in a paper tray to the printing mechanism. A pickup roller is mounted in a typical feeding device, and papers are fed sheet by sheet by friction between paper loaded on a paper feeding plate (or knock up plate) and a powered pickup roller. There are two kinds of pickup roller methods in general use: one is a method using a circular pickup roller, and the other is a method using a semicircular pickup roller.

The method of arranging papers in a device using a circular pickup roller is described as follows. A paper is transported from a paper load cassette by rotation of a pickup roller. A paper transported by the pickup roller is transported to the contact line of a feed roller and a pinch roller, rotating in the counter direction to the paper processing direction. The front edge of the paper and the contact line of the feed roller and a pinch roller coincide exactly because a curl occurs in the fed paper. The feed roller then rotates in the forward direction (paper processing direction), and the pickup roller enters an idling state in which driving power is intercepted. However, this method produces a load on the paper on the paper feed plate from the pickup roller.

The most important reason that a semicircular pickup roller is adapted is to eliminate the load on a paper after the paper feeding is finished. That is, as feeding is finished, the transported paper becomes free as the paper feeding plate exchanges with the pickup roller. In this method, no curl occurs on a paper due to a counter rotation, and it is essential that a guide in the horizontal direction and at right angle to a feed roller be used for preserving the proper orientation of the paper. Therefore, a side of a paper is guided using a guide without a diversion. When papers are fed separated, sheet by sheet, however, any resistance to one side of a paper by, for example, the user's finger, will lead to distortion at the time of feeding in spite of using a guide. Also, in some devices two pickup rollers are used. Here, the feeding direction can be misguided and distorted due to inequality of input/output of the pickup rollers.

Based on my observation of the art, then, I have discovered that what is needed is a paper aligning apparatus which avoids the problem of continuous load on the paper seen with circular pickup rollers, and the problem of misguiding seen with semicircular pickup rollers.

SUMMARY OF THE INVENTION

Therefore it is an object of the present invention to provide an improved paper feeding device for a printer.

It is another object of the present invention to provide a paper feeding device which does not put a load on the paper when the paper is being fed.

It is a further object of the invention to provide an improved paper aligning apparatus for a paper feeding device using a semicircular pickup roller.

It is a still further object to provide a paper aligning apparatus which prevents misguiding of the paper when papers are hand-fed sheet by sheet.

It is a yet further object to provide a paper aligning apparatus which prevents misguiding of the paper due to a mismatch of the pickup rollers in a paper feeding device using two pickup rollers.

The present invention achieves these objects by providing a method for paper alignment involving aligning the horizontal directional axis of a feed roller with the front edge of a paper and removing a load to a transported paper while it is fed. There is provided a device for paper alignment including a feeding means having a feed roller and a pinch roller which are adjacent to each other for feeding a paper; a pickup roller for picking up a paper loaded in a cassette and for supplying the paper to the feeding means; a paper feed plate (or knock up plate) for offering frictional power to the supplied paper to pick up a paper; and a one-way clutch for preserving frictional power of the pickup roller against a paper when the feed roller formed on the same axis with the pickup roller drives in a counter direction.

A further characteristic of the present invention is to provide a one-way clutch including: a cam which rotates in the same direction with the pickup roller, and which pushes the paper feed plate in order to eliminate a load to a paper after a paper enters the feeding means; a catch (or latch) device retarding gear rotation of the pickup roller when the feed roller drives in a counter direction at the moment that a paper is inserted into a gap of a roller part; and a lever retarding a rotation of the catch device when the feed roller rotates in a counter direction.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
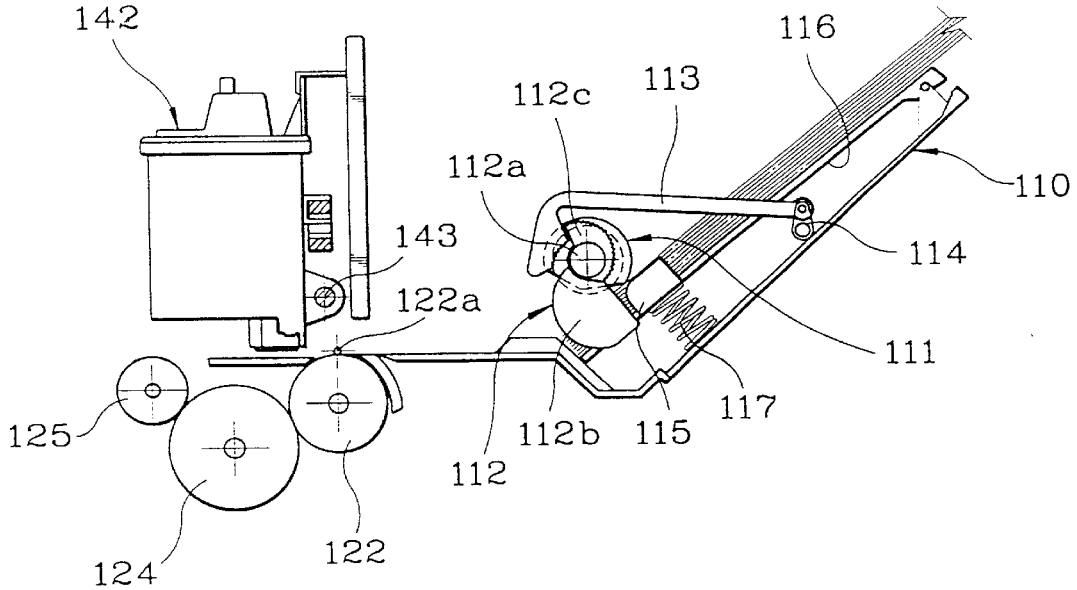
FIG. 1 illustrates an elevational view of a device for paper alignment according to the present invention in an initial state.

Hereinafter, a preferred embodiment of the present invention will be described with reference to the attached drawings as follows. FIG. 1 illustrates an initial state of a device for paper alignment according to the present invention. Feeding devices may be considered to have two parts, a paper feed part and a paper transport part. Paper feed part means a device equipped with a paper tray as a main part, and paper transport part is composed of a plurality of rollers.

Paper tray 110 of paper feed part includes paper feed plate (or knock up plate) 116, pressure-adding spring 117 which creates regular pressure to paper feed plate 116, and pickup roller 111 equipped for rotation. A numbers of semicircular bands of rubber are formed with a regular interval along the pickup roller, and one-way clutch part 112 is attached at one side of pickup roller 111 for preventing pickup roller 111 from rotating in a counter direction. One-way clutch part 112 rotates in the same direction with the pickup roller 111, and comprises cam 112*b* which pushes against 18 paper feed plate 116 in order to eliminate a load to a paper when it is transported; catch (or latch device) 112*c* which retards rotation of pickup roller 111 in the counter direction when a paper is transported by the paper transport part in the counter direction, to arrange the paper; lever 113 retarding rotation of the catch 112*c*; and support member 114 for fixing lever 113 to paper tray 110.

Paper transport part comprises feed roller 122 which transports a paper, pinch roller 122*a* which is adjacent to feed roller 122 and between which there may be a little gap, idle gear 124 which is engaged with feed roller 122 and which transmits driving power to a pickup roller 125. Ink cartridge 142 moves in a horizontal direction, perpendicular to the plane of FIG. 1, along the axis of guide bar 143. Cam 112*b* is shown detached from push plate 115 of knock up plate 116, and a part of pickup roller 111 touches a paper by the effect of pressure-adding spring 117.

Figure 2:
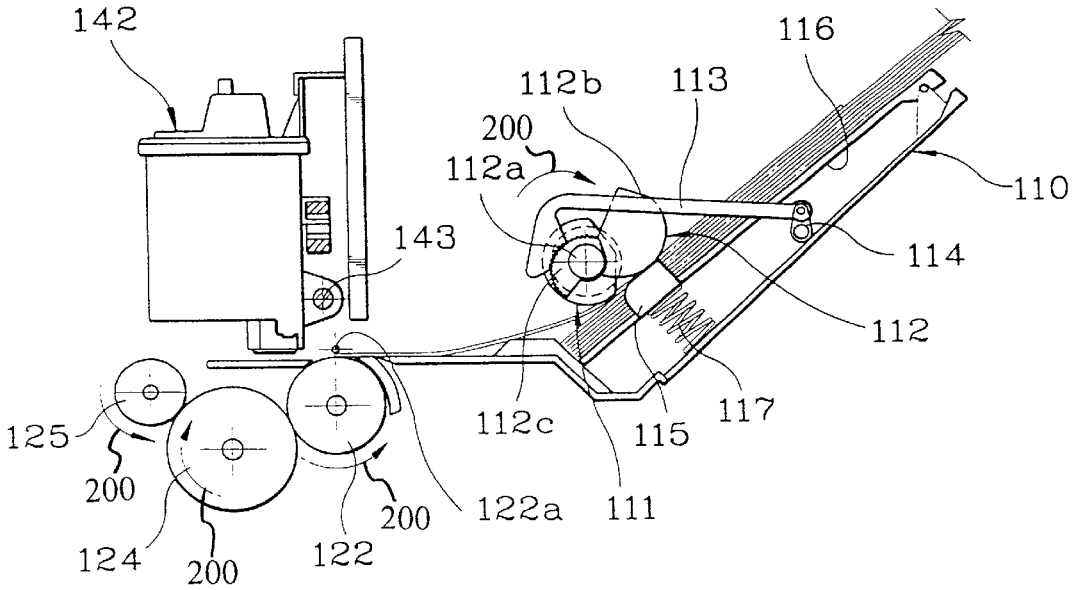
FIG. 2 is an elevational view of a state during the feeding operation of a device for a paper alignment according to the present invention.

FIG. 2 is a state view of a feeding operation of a device for a paper alignment according to the present invention. The feeding operation begins with a driving of feed roller 122 in a paper processing, or forward, direction. Directions of motion are indicated by semicircular arrows Pickup roller 111 (not visible in FIG. 2) rotates according to the driving of feed roller 122; the coupling of feed roller 122 and pickup roller 111 can be provided by a gear, belt, or similar arrangement (not shown). Cam 112*b* and catch 112*c* rotate in the paper processing direction according to the rotation of pickup roller 111. A paper transported by pickup roller 111 is shown entering between feed roller 122 and pinch roller 122*a*. At this time, a circular side of cam 112*b* nears push plate 115 of paper feed plate 116. The paper receives a load by contact with a part of pickup roller 111 by the effect of pressure-adding spring 117 since power is not yet transmitted to push plate 115 of paper feed plate 116.

Figure 3:
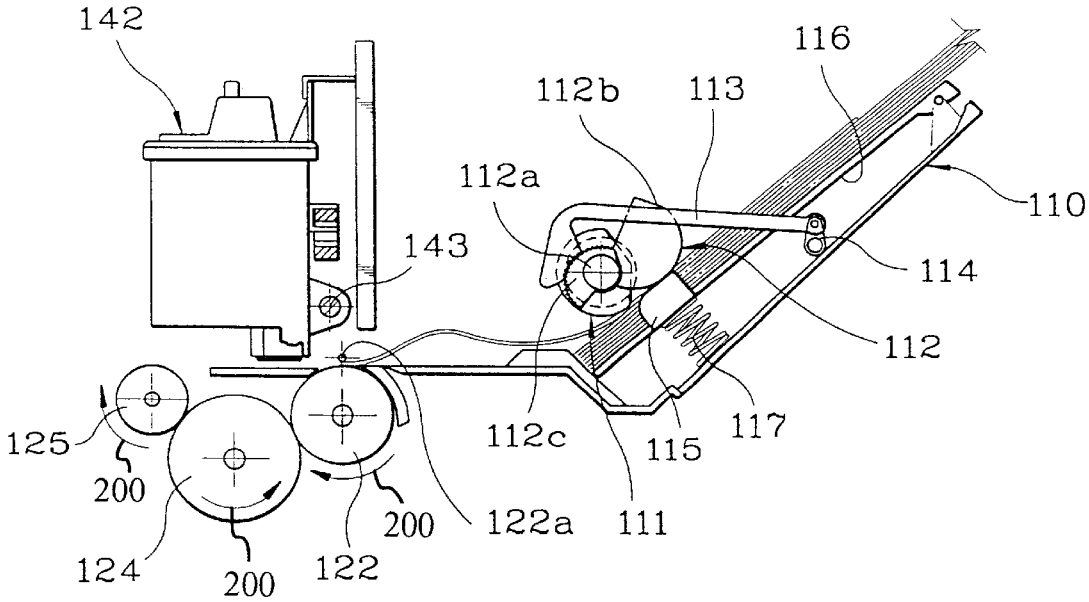
FIG. 3 is an elevational view of a state during the operation of a paper alignment of a device for a paper alignment according to the present invention.

FIG. 3 is a state view of an operation of a paper alignment of a device for a paper alignment according to the present invention. Feed roller 122 is rotated in a counter direction to the paper processing direction at a state when the paper has entered a little bit between feed roller 122 and pinch roller 122*a*. At this time, pickup roller 111 is prevented from rotating by the engagement of catch 112*c*, which is connected with pickup roller 111, with a one-way saw-tooth formed on lever 113. A curl occurs on the paper because the paper is held between a plate of pickup roller 111 and paper feed plate 116 due to the load, that is pressure, by pressure-adding spring 117, and because feed roller 122 and pinch roller 122*a* rotate in a counter direction to the paper processing direction. The edge of the paper that had entered feed roller 122 and pinch roller 122*a* is thus released from between these rollers, and is evenly pressed against the contact line of these rollers. Therefore, alignment operation of a paper edge is possible in which a paper edge touches the contact line of feed roller 122 and pinch roller 122*a*.

Figure 4:
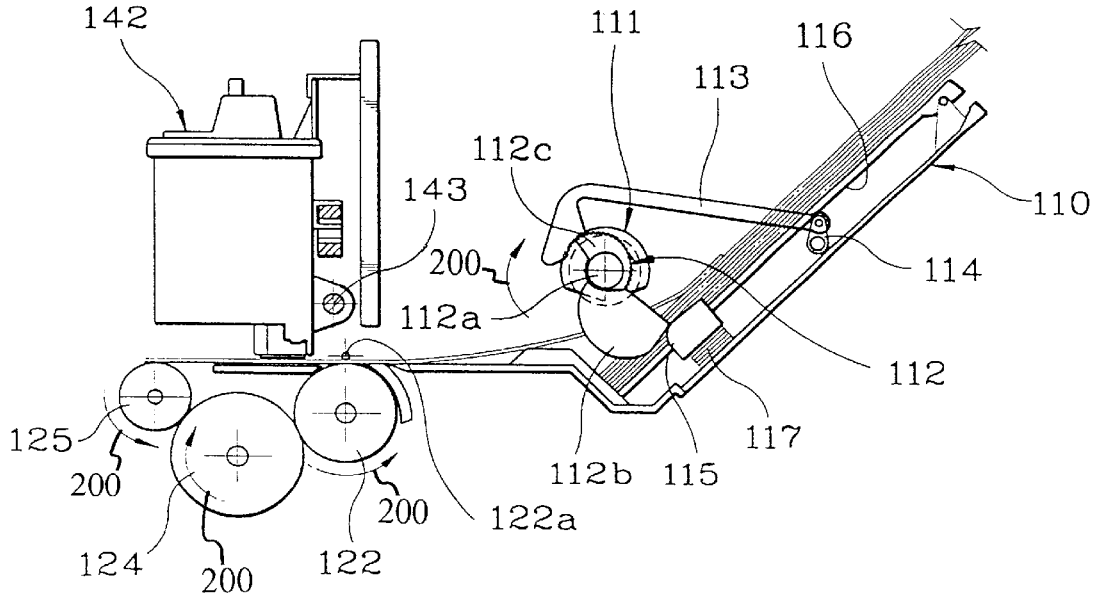
FIG. 4 is an elevational view of a state during the operation of paper transportation of a device for a paper alignment according to the present invention.

In the state that the above paper alignment has occurred, as shown in FIG. 4, feed roller 122 is rotated in the forward, paper processing direction. Cam 112*b* connected to pickup roller 111 Is presses push plate 115 of paper feed plate 116 and paper feed plate 116 moves away from pickup roller 111 eliminating the load to the paper.

Figure 5:
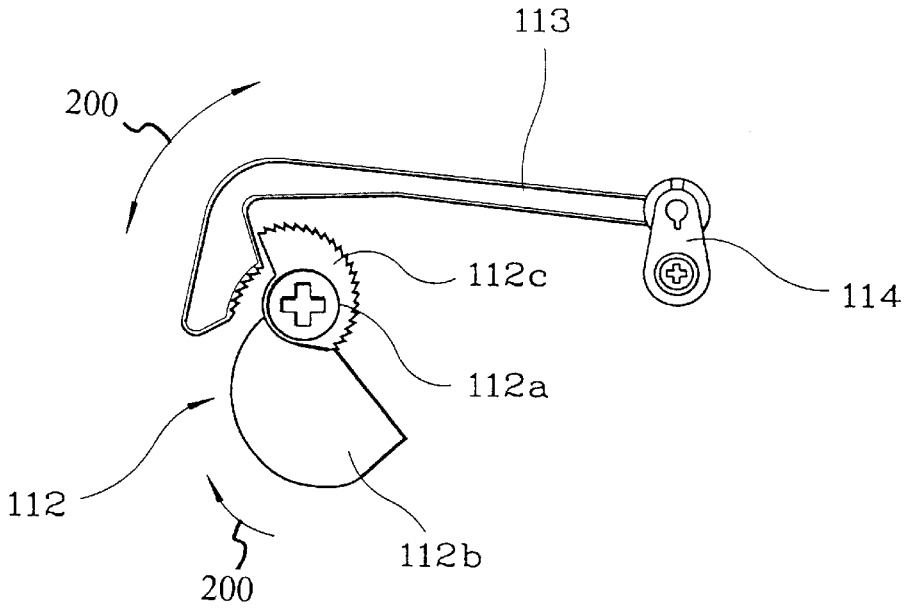
FIG. 5 is a right side view of a one-way clutch according to the present invention.

FIG. 5 is a right side view of a one-way clutch according to the present invention. Lever 113 moves up and down as it rotates about the axis of support member 114 as illustrated. Cam 112*b* connected to pickup roller 111 by support member 112*a* and catch 12*c* are seen to rotate only in one direction, as shown by arrows 200.

Figure 6:
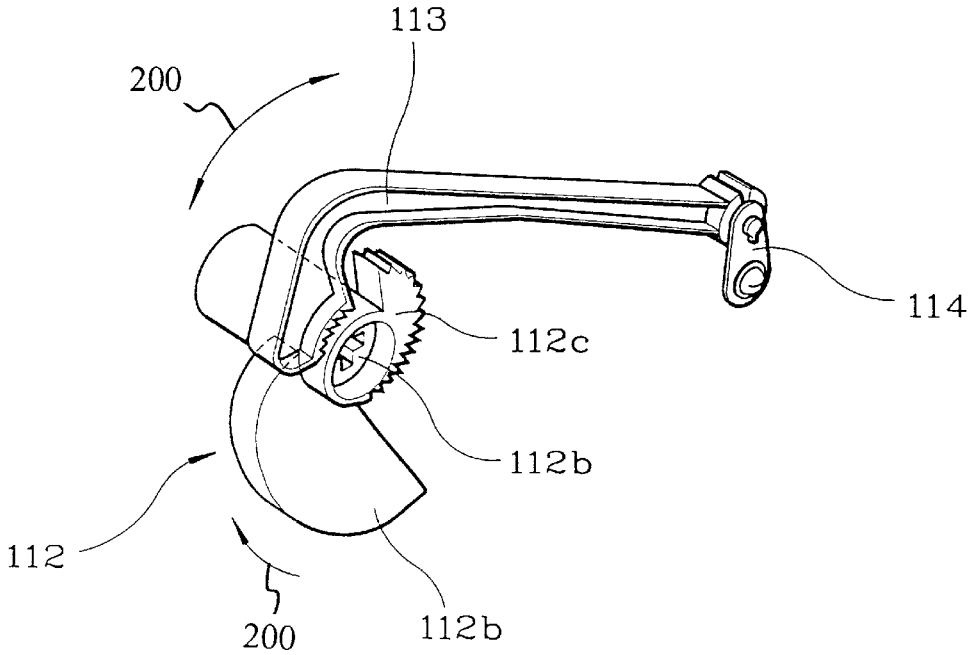
FIG. 6 is a perspective view of a one-way clutch according to the present invention.

FIG. 6 is a perspective view of a one-way clutch according to the present invention. Saw-tooth formed on lever 114 and saw-tooth of catch 112*c* have regular angles, therefore when lever 114 and latch device 112*c* are engaged with each other, catch 112*c* is retarded from rotating in the counter direction and therefore pickup roller 111 connected by support member 112*a* is prevented from rotating in the counter direction. The rotation of cam 112*b* geared with pickup roller 111 is not affected by lever 114.

As described above, the present invention has the effect of creating a curl on a paper by retarding the coupling of a pickup roller to a feed roller rotating in the counter direction, for the purpose of paper alignment in a paper feeding device.

What is claimed is:

1. An apparatus for aligning a paper to be printed, comprising:

a feeding apparatus having a feed roller and a pinch roller parallel to and close to said feed roller, said feed roller and pinch roller having fixed rotation axes during operation of the printer;

a paper supply apparatus oriented to supply a paper to said feeding apparatus, comprising:

a paper tray;

a paper feed plate mounted in said paper tray and underlying the paper;

a pickup roller which is semicircular in shape over a portion of its length, said pickup roller positioned to contact the paper and oriented parallel to said feed roller;

a spring pressing said paper feed plate toward said pickup roller;

mechanical coupling means for coupling the rotation of said feed roller and pinch roller to said pickup roller;

driving means for driving said feed roller and pinch roller in a forward and reverse direction; and a one-way clutch preventing rotation of said pickup roller in the reverse direction;

said one-way clutch comprising:

a lever having an approximate L-shape and being rotatably attached to a side of said paper tray, said lever having a directional saw-tooth region roughly facing the axis of said pickup roller; and a catch mounted to an end of said pickup roller on said side of said paper feed tray, said catch having a saw-tooth region complementary to the saw-tooth region of said pickup roller, such that said saw-tooth region of said catch engages said saw-tooth region of said lever during rotation of said pickup roller.

2. The apparatus of claim 1, further comprising:

said paper feed plate comprising a push plate along a side edge of said paper feed plate corresponding to said side of said paper tray;

said one-way clutch further comprising a cam mounted to said end of said pickup roller, such that said cam engages said push plate during rotation of said pickup roller.

* * * * *